US005992764A

United States Patent [19]

Bougamont et al.

[11] Patent Number: 5,992,764

[45] Date of Patent: Nov. 30, 1999

[54] NOZZLE FOR DISPENSING A LIQUID OR PASTY MATERIAL

[75] Inventors: Jean-Louis Bougamont; Pascal Hennemann, both of Eu, France

[73] Assignee: Sofab, Le Treport, France

[21] Appl. No.: 09/091,824

[22] PCT Filed: Jan. 7, 1997

[86] PCT No.: PCT/FR97/00021

§ 371 Date: Jul. 8, 1998

§ 102(e) Date: Jul. 8, 1998

[87] PCT Pub. No.: WO97/25253

PCT Pub. Date: Jul. 17, 1997

[30] Foreign Application Priority Data

Jan. 8, 1996 [FR] France ..... 96 00120

[51] Int. Cl.[6] ..... B65D 47/20

[52] U.S. Cl. ..... 239/459; 239/327; 239/570

[58] Field of Search ..... 401/260, 264; 222/395, 402.2, 42.5, 450, 451, 215; 239/570, 574, 533.13, 327, 459, 451, 533.1, 456

[56] References Cited

U.S. PATENT DOCUMENTS

| | | | |
|---|---|---|---|
| 2,060,455 | 11/1936 | Wittner | 222/451 |
| 2,106,046 | 1/1938 | Barlow et al. | 401/260 |
| 2,815,247 | 12/1957 | Hogeman | 239/456 X |
| 3,379,490 | 4/1968 | Schwartzman | 401/264 X |
| 3,863,844 | 2/1975 | McMillan | 239/570 |

*Primary Examiner*—Kevin Weldon
*Attorney, Agent, or Firm*—Bacon & Thomas PLLC

[57] ABSTRACT

A nozzle for dispensing a liquid or semi-liquid substance (P) and designed to be mounted on a tank (R) suitable for being put under pressure. The nozzle is of the type comprising a thimble (1) and moving shutter (2) housed inside the thimble. The thimble (1) is provided with a coupling end (11) for coupling to the tank (R) and an ejection orifice (10). The shutter (21) is constituted by a rod (21) carrying a plug (20) at an outer end thereof. The plug (20) cooperates with the ejection orifice (10) to form a delivery valve. The rod (21) also carries a transverse wall (22) at an inner end thereof. The wall (22) leaves a passage for the substance (P) and cooperates with a resilient return means (3) for returning the moving shutter (2) towards a closed position in which the plug (20) is engaged in sealed manner in the ejection orifice (10). The nozzle further comprises an admission valve constituted by a deformable peripheral lip (23) around the rod (21) which subdivides the passage for the substance (P) in sealed manner into an upstream compartment and a downstream compartment.

18 Claims, 6 Drawing Sheets

NOZZLE FOR DISPENSING A LIQUID OR PASTY MATERIAL

This application is a 371 of PCT/FR97/00021 filed Jan. 7, 1997.

BACKGROUND OF THE INVENTION

1. Field of the Invention

The present invention relates to a nozzle for dispensing liquid or semi-liquid substances.

2. Description of the Related Art

There already exist dispenser nozzles designed to be mounted on tanks and suitable for being put under pressure.

In general, the delivery valve is situated inside the pump mechanism that serves to deliver the substance. The pump is actuated by a pushbutton forming a spray-nozzle.

Nevertheless, since the nozzle is mounted downstream from the delivery valve, there remains a volume of substance that is exposed to air between said valve and the ejection orifice of the nozzle.

In certain fields of application, and in particular with pharmaceuticals and cosmetics, this volume of substance that is not protected from the outside atmosphere can become contaminated by bacterial pollution or can dry out and thus block the ejection duct.

Under such conditions, the substance remaining in the tank becomes unusable.

To remedy that difficulty, CH-A-178923 proposes a nozzle comprising:

a thimble provided firstly with a coupling end for coupling to the tank and secondly with an ejection orifice; and a moving shutter housed inside said thimble, the shutter being constituted by a rod carrying a plug at its outer end which co-operates with the ejection orifice to form a delivery valve, and carrying a transverse wall at its inner end that leaves a passage for the substance and that co-operates with resilient return means for returning the moving shutter towards a closed position in which the plug is engaged in sealed manner in the delivery orifice.

Nevertheless, since the shutter is actuated manually, the pressure difference that controls both opening and closing of the delivery valve is small (about 0.1 bars).

This means that after the shutter has been released and the delivery valve has closed, sealing is not sufficiently effective to ensure that no air is taken in.

Under such conditions, there remains a risk of the substance becoming polluted.

An object of the present invention is to solve that technical problem in satisfactory manner by improving sealing of the nozzle so that it can be used with sterile substances.

SUMMARY OF THE INVENTION

According to the invention, this object is achieved by a nozzle designed to be mounted on a tank and suitable for being put under pressure, the nozzle being of the type comprising:

a thimble provided firstly with a coupling end for coupling to the tank and secondly with an ejection orifice; and a moving shutter housed inside said thimble, the shutter being constituted by a rod carrying a plug at its outer end which co-operates with the ejection orifice to form a delivery valve, and carrying a transverse wall at its inner end that leaves a passage for the substance and that co-operates with resilient return means for returning the moving shutter towards a closed position in which the plug is engaged in sealed manner in the delivery orifice;

the nozzle being characterized in that it further comprises an admission valve constituted by a deformable peripheral lip subdividing the passage for the substance around the rod in sealed manner into an upstream compartment and a downstream compartment.

In an advantageous embodiment, said lip is secured to the rod, and, in the closed position of the valve, the free end of the lip is in bearing contact against the inside wall of the thimble.

In a particular embodiment, said lip is carried by a ring that is coaxial with the rod.

Preferably, said transverse wall is integrally formed with said ring.

In another embodiment, the upstream end of the lip is secured to the rod.

In yet another embodiment, said transverse wall is resiliently deformable and is retained by its peripheral edge at the coupling end of the thimble, thereby forming resilient return means for the shutter.

According to an advantageous characteristic, said rod is axial and together with the transverse wall it defines a peripheral shoulder.

In a variant embodiment, said resilient return means comprise a helical spring surrounding the rod of the shutter and having a rear end bearing against the shoulder and a front end bearing against the inside wall of the thimble.

According to a particular characteristic of this variant, the front end of the spring bears against longitudinal ribs extending along the inside wall of the thimble.

According to another characteristic of this variant, the front end of the spring bears against the bottom of an annular groove formed in the inside wall of the thimble and defined on its inside edge by a collar for guiding the rod.

In another embodiment, said plug is constituted firstly by a body whose side face in the closed position is pressed in sealed manner against the inside edge of the ejection orifice, and secondly by a head projecting to the outside of the thimble.

In a specific variant, the ejection orifice has a frustoconical profile corresponding to the profile of the body of the plug. Where appropriate, the inside edge of the ejection orifice is provided with an annular ring against which the side face of the plug body bears in sealed manner when closed.

In yet another embodiment, the thimble has a bullet-shaped profile, and the head of the plug has a curvilinear profile of curvature defined so as to appear to continue the bullet-shaped profile.

According to further characteristics, the coupling end of the thimble has ribs on its inside wall constituting an abutment for the transverse wall.

According to another characteristic, said rod is secured to the transverse wall by being engaged in a clamping sleeve carrying said wall.

Preferably, the nozzle further comprises a removable cap designed to cover the thimble and having an end wall whose inside face bears against the plug so as to guarantee that it is sealed in the closed position.

It is also possible to provide for said transverse wall to be extended towards the tank by means of a stud engaged in a sleeve projecting into said tank.

The nozzle of the invention possesses a combination of two valves making it possible to control sealing, thereby preserving the entire contents of the tank from coming into any contact with the outside atmosphere and thus avoiding any risk of the substance being degraded or contaminated with bacteria. The nozzle can be mounted in simple manner on the tank, internally or externally, directly or indirectly via a coupling.

The substance to be found in the upstream compartment of the nozzle is protected in the same manner and with the same effectiveness as if it were in the tank.

The two valves which are mounted on the same part operate in the same sense but their displacements extend along distinct axes.

By generating pressure above a certain threshold within the substance inside the tank, the shutter is caused to move and substance is ejected. Below the threshold, the shutter is in a sealed closure position on the nozzle under drive from the return means.

In addition, the structure of the nozzle prevents any accidental egress or leakage of the substance to the outside. The cap covering the thimble and pressing against the plug of the shutter holds it in the sealed closure position against the valve seat. This disposition guarantees that the nozzle is sealed even if pressure should be generated accidentally within the substance in the tank.

BRIEF DESCRIPTION OF THE DRAWINGS

The invention will be better understood on reading the following description and from the accompanying drawings, in which.

DETAILED DESCRIPTION OF THE PREFERRED EMBODIMENTS

Figure 1:
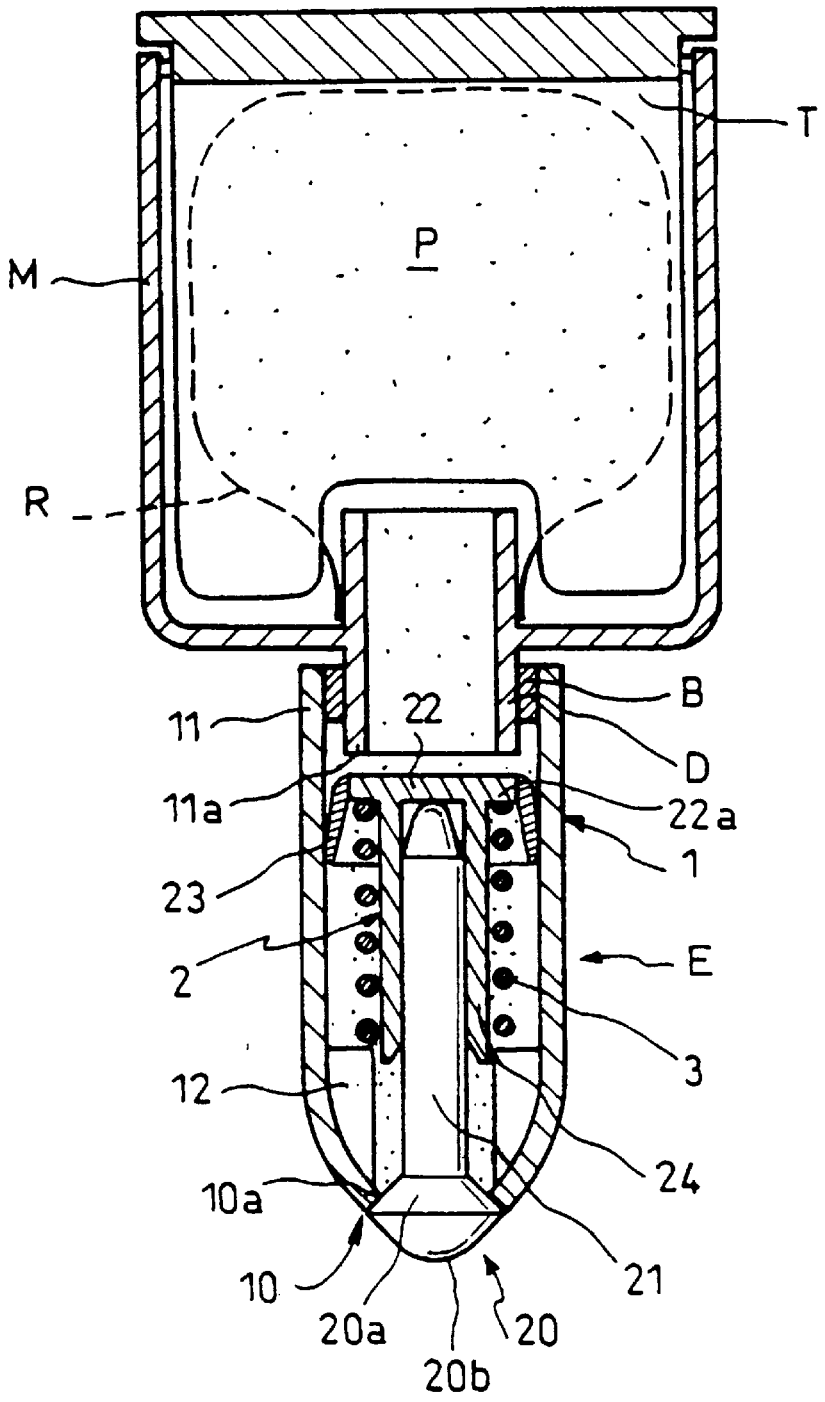
FIG. 1 is a longitudinal section view through a first embodiment of the nozzle of the invention, shown in its closed position and mounted on a tank.

The nozzle E shown in FIG. 1 is designed to be mounted on a tank R which is constituted in this case by a flexible bag filled with a liquid or semi-liquid substance P and secured in hermetically sealed manner to a coupling D.

The bag R is capable of being put under pressure either by direct manual action, or else by paddles T slidably mounted on an upright M secured to the coupling D. This ensures that the bag R is kept inside a rigid structure.

According to the invention, the nozzle E has a thimble 1 provided with an end 11 for coupling to the coupling D of the bag R via a ring B, and with an ejection orifice 10.

The nozzle E also has a moving shutter 2 housed inside the thimble 1 and providing a passage for the substance P from the coupling D to the ejection orifice 10.

The shutter 2 is constituted by a rod 21 having a plug 20 at its outer end that co-operates with the ejection orifice 21 to form a delivery valve.

Figure 2:
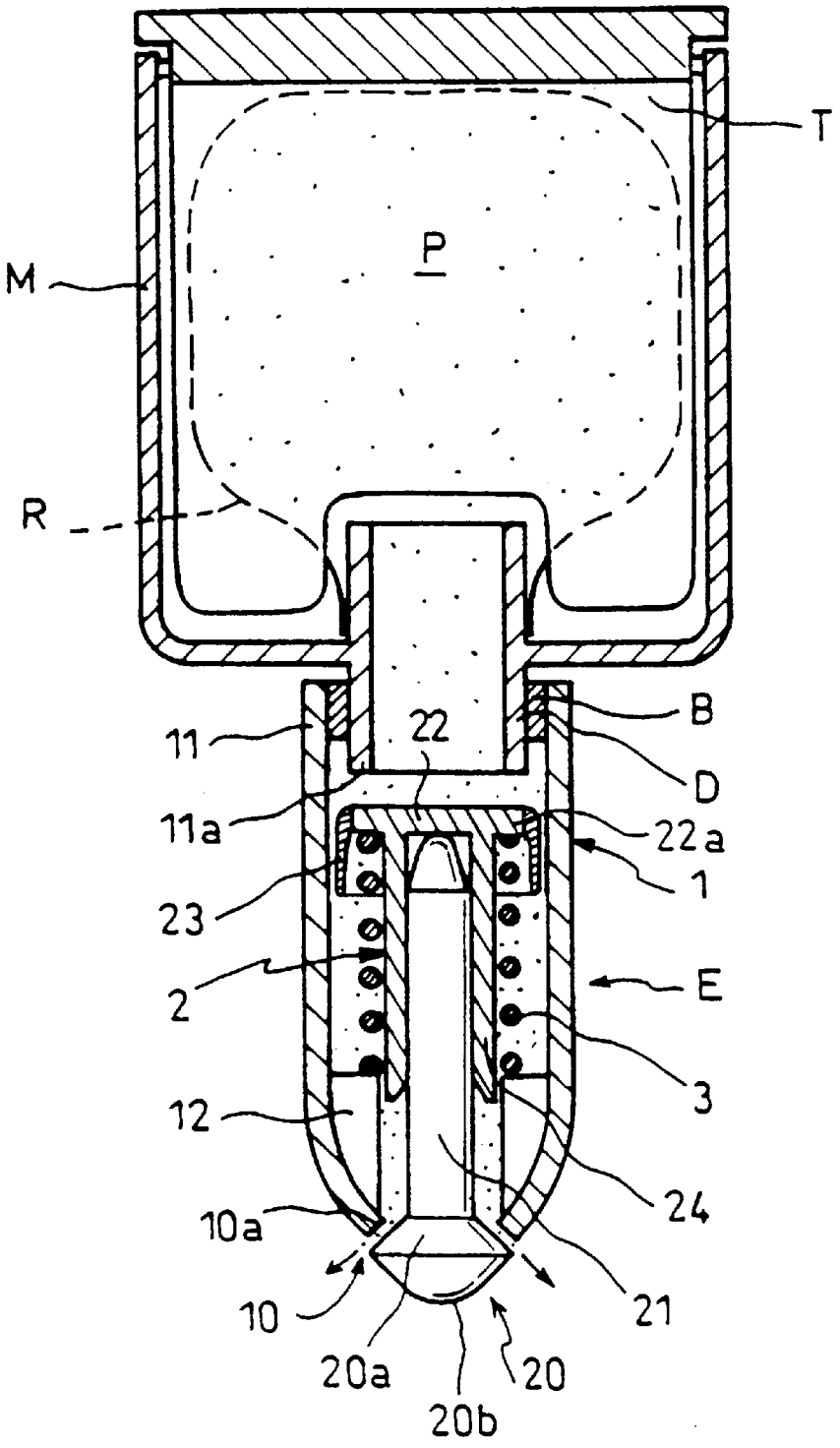
FIG. 2 is a longitudinal section view of the FIG. 1 nozzle in its open position.

The inner end of the rod 21 is provided with a rigid transverse wall 22 co-operating with shutter return means. The wall 22 is secured to the rod 21, either by being integrally formed therewith, or, as shown in FIGS. 1 and 2, being carried by a clamping sleeve 24 made as a separate part, with the inner end of the rod 21 being engaged therein.

In the embodiment shown, the rod 21 is axial and co-operates with the wall 22 to define a peripheral shoulder 22*a* which extends radially towards the inside wall of the thimble 1 via an elastically deformable peripheral lip 23 constituting an admission valve. The lip 23 is integrally formed with the wall 22 and the sleeve 24, constituting a ring thereabout. In the closed position of the valve, the lip 23 thus subdivides the passage for the substance in sealed manner into an upstream compartment situated adjacent to the end 11 of the thimble 1 capable of communicating with the tank R, and a downstream compartment capable of communicating with the outside via the orifice 10.

The lip 23 thus forms a coaxial ring secured to the rod 21 via its upstream end while its free downstream end, as shown in the closed position of FIG. 1, comes into bearing contact against the inside wall of the thimble 1.

In this case, the shutter 2 is fitted with return means constituted by a spring.

The return spring 3 surrounds the rod 21 coaxially and thus has a rear end turn bearing against the shoulder 22*a*, thereby urging the moving shutter 2 towards its closed position. The front end turn of the spring 3 bears against longitudinal ribs 12 extending over the inside wall of the thimble 1 in the vicinity of the orifice 10 over a length that is determined as a function of the characteristics of the spring.

The plug 20 is constituted by a body 20*a* whose side face, in the closed position, bears in sealed manner against the inside edge 10*a* of the ejection orifice 10, thereby forming the seat of the delivery valve. The sealed bearing contact is thus provided between two surfaces that are conical. In another embodiment (not shown) it is possible to provide an annular ring formed on the inside edge 10*a* of the ejection orifice 10. Contact is then provided between the side face of the body 20*a* of the plug 20 and said ring, thus reducing contact to a circular line, thereby reinforcing the sealing bearing force. The body 20*a* is extended by a head 20*b* which projects forwards out from the thimble 1.

The ejection orifice 10 is preferably frustoconical in shape, corresponding to the shape of the body 20*a* of the plug 20.

The profile of the thimble 1 is bullet-shaped, while the head 20*b* of the plug 20 has a curvilinear profile of curvature that is determined so as to ensure that the bullet-shaped profile is continuous in appearance.

When the pressure from the substance P is exerted on the wall 22 of the rod 21, the shutter 2 moves forwards from its closed, rear position in which the plug 20 is engaged and retained in sealed manner in the ejection orifice 10.

This displacement can take place only providing the pressure that is exerted exceeds a threshold that is determined by the rating of the helical spring 3 which is compressed under the effect of the thrust. The substance P then deforms the lip 23 elastically and penetrates into the downstream compartment by going round the outside of the wall 22. Then, inside the downstream compartment the substance P goes through the turns of the spring 3, into the space that extends between the inside wall of the thimble 1 and the sleeve 24 and/or the rod 21 of the shutter 2, heading towards the ejection orifice 10, by pushing against and flowing round the body 20*a* of the plug 20, prior to escaping to the outside.

The ejection mechanism can be adjusted, for example, by providing for the spring 3 to continue to be slightly compressed in the closed position of the shutter so as to reinforce sealing.

Under such circumstances, it is the thrust of the side face of the body 20*a* of the plug 20 forced against the inside edge 10*a* of the ejection orifice 10 that holds the front end of the shutter in its closed position.

In a variant, provision can be made for the coupling end 11 of the thimble 1 or the coupling D to include, on its inside wall, ribs 11*a* that form rear abutments for the wall 22 during return of the shutter towards its closed position.

In the variant shown, the ribs 11*a* are formed by the edges of the coupling D.

Figure 3:
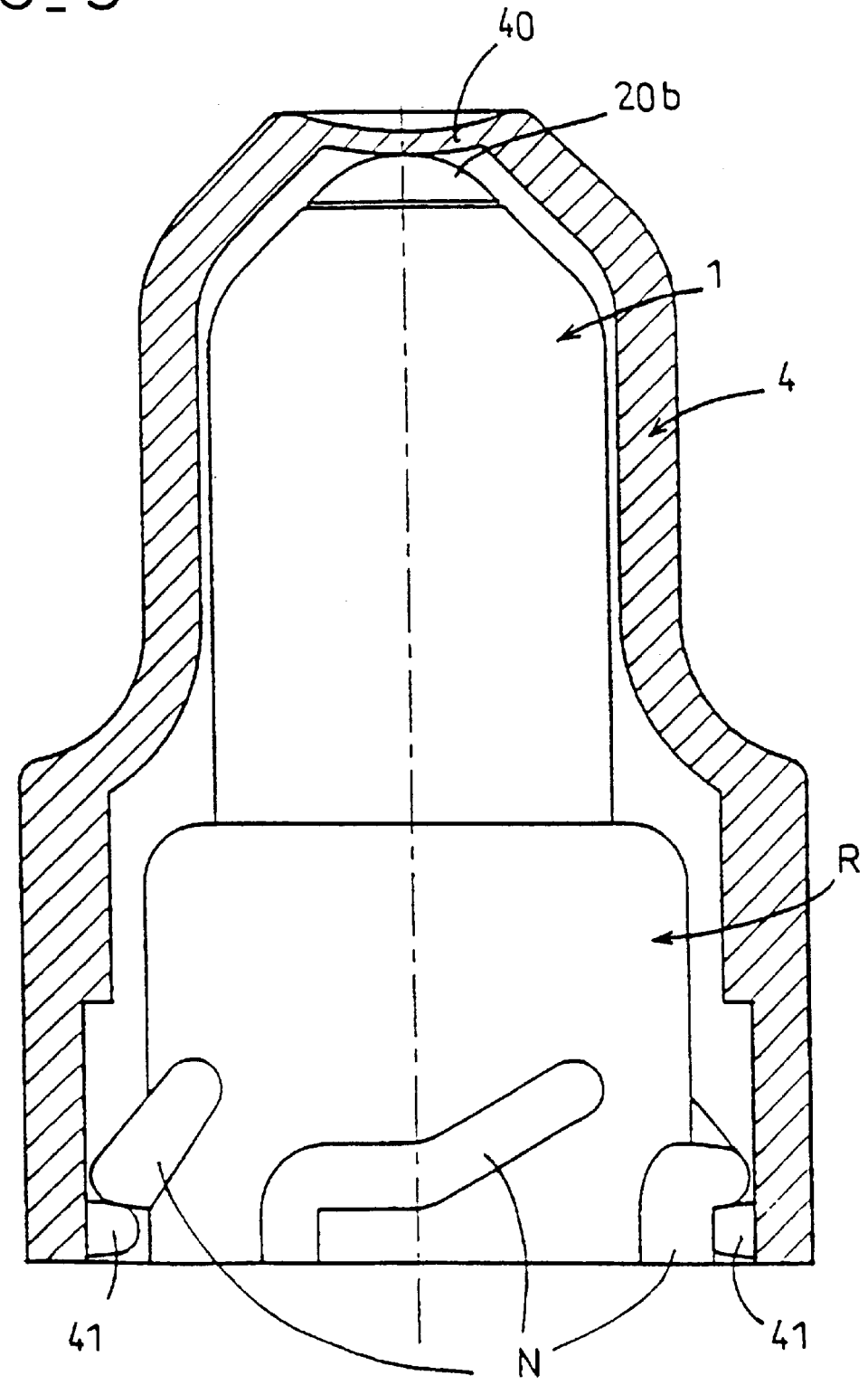
FIG. 3 is a section view of a cap covering the thimble which is itself shown in elevation and in the closed position.

In FIG. 3, the nozzle is provided with a removable cap 4 for putting over the thimble 1.

The top of the cap 4 has a hollow portion 40 of reduced wall thickness which bears via its inside face against the head 20*b* of the plug 20 so as to guarantee closure sealing.

By way of example, the cap 4 can be screwed externally on the end 11 of the coupling of the thimble 1, or on an external ring, or as shown in FIG. 3, directly onto the wall of the rigid tank R.

To this end, the wall of the tank R is provided with ribs N forming threads that co-operate with corresponding ribs 41 formed on the inside wall of the cap 4 for screw-fastening purposes.

The positions and the shapes of the ribs 41 and N are designed so as to ensure that the hollow portion 40 bears against the plug 20 when the cap is screwed home.

Where appropriate, the cap is provided with an internal stiffener element 42 (see FIGS. 5*a* and 5*b*) bearing against the top portion of the tank R.

Figure 4:
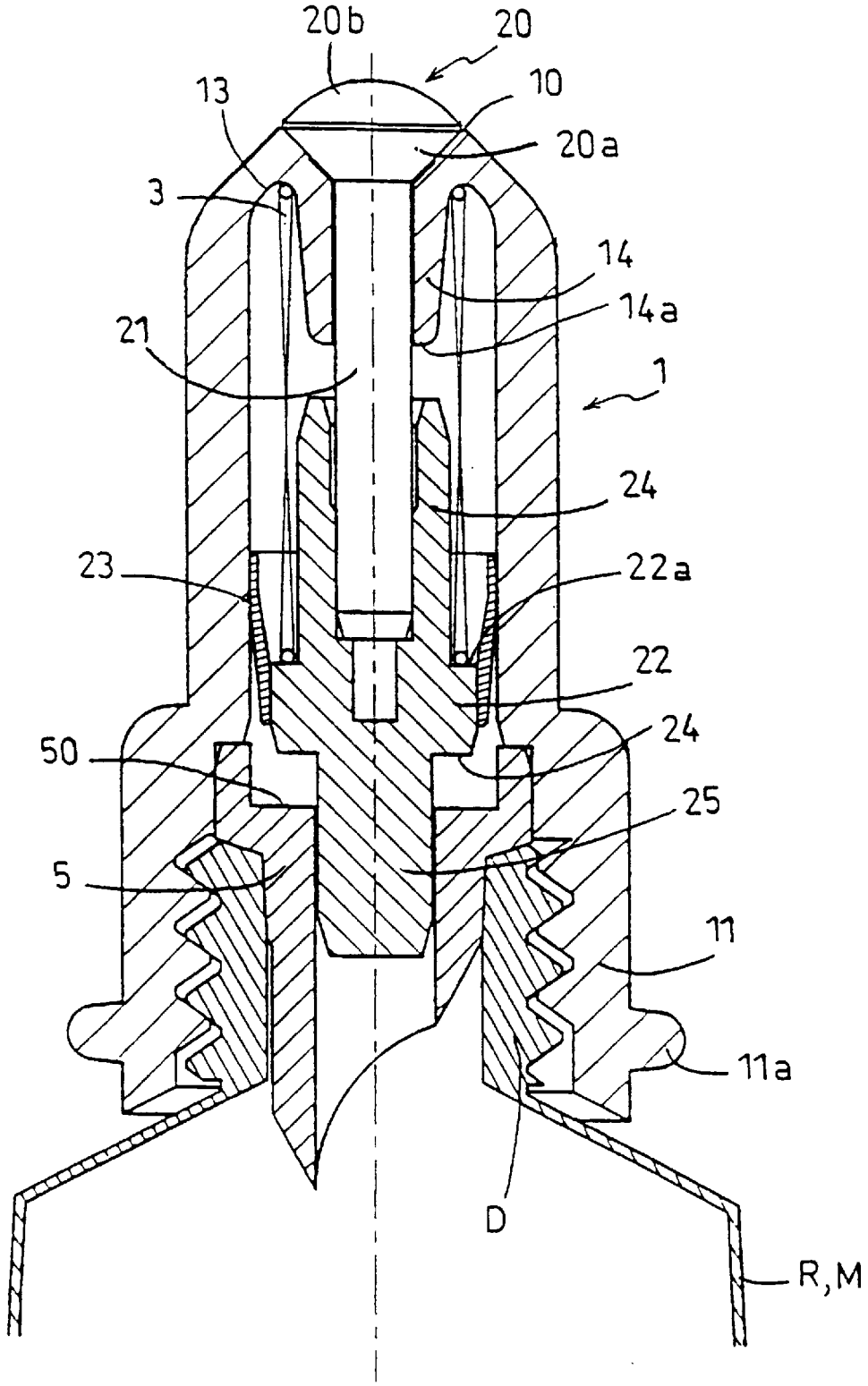
FIG. 4 is a section view through a second embodiment of the nozzle.
Figure 5A:
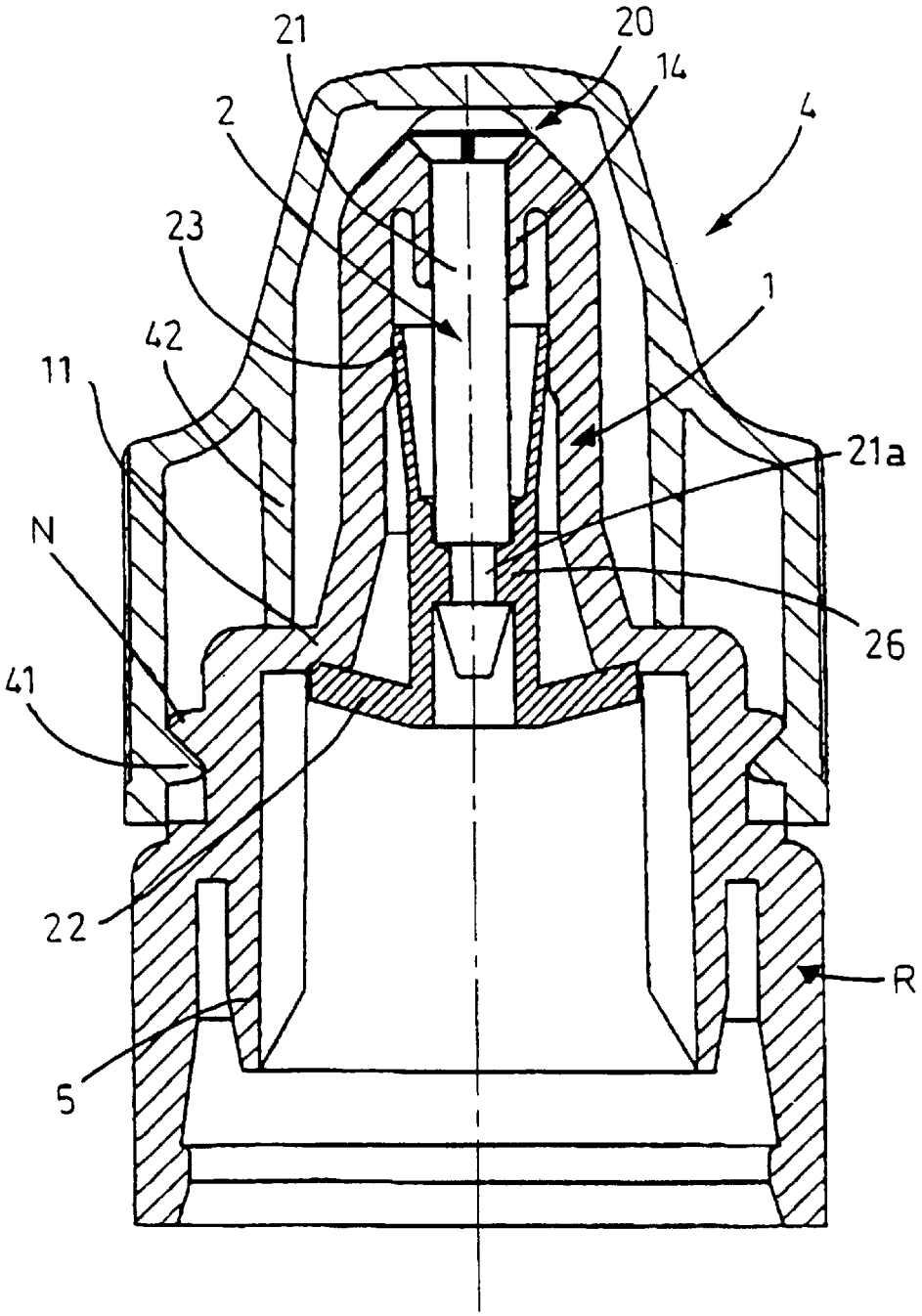
FIGS. 5*a* and 5*b* are section views of a third embodiment of the nozzle of the invention shown respectively in the closed position and in the open position.
Figure 5B:
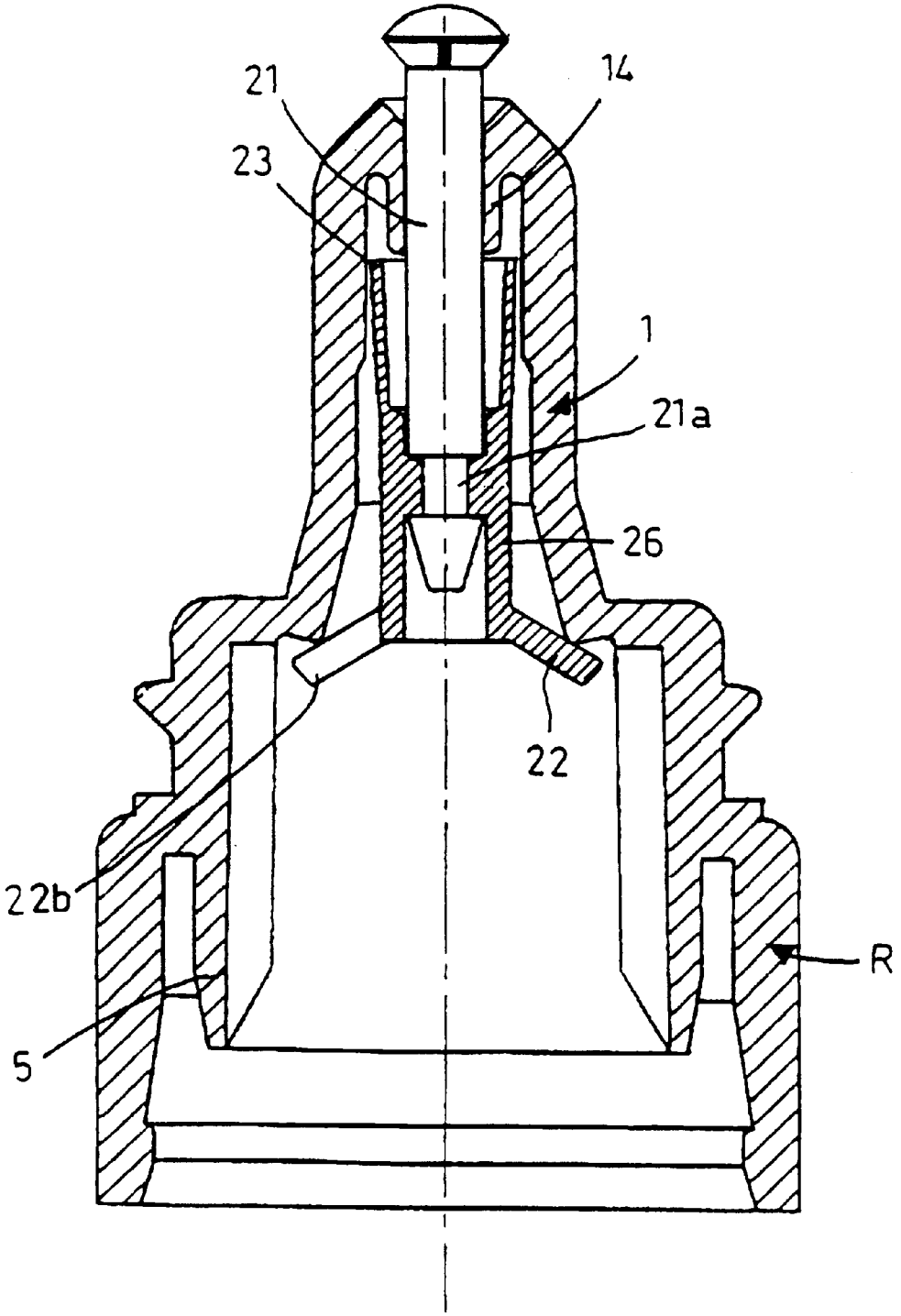

In the embodiment of FIG. 4, the wall 22 carrying the peripheral lip 23 of the admission valve is extended towards the tank R by a stud 25 which is engaged in a sleeve 5, itself received in the coupling D and projecting into the inside of the tank R.

Where appropriate, the sleeve 5 is secured to the inside wall of the end of the coupling 11 of the thimble 1 or of the coupling D (see FIGS. 5*a*, 5*b*). In the present case, the end of the coupling 11 is screwed onto the coupling D and possesses a peripheral collar 11*a*.

The sleeve 5 has a shoulder 50 placed facing the rear face 24 of the wall 22.

In this embodiment, the front end of the spring 3 bears against the bottom of an annular groove 13 formed on the inside wall of the end of the thimble 1. The groove 13 is defined on its inside edge by a collar 14 serving to guide the rod 21 during axial movement thereof. The free inside edge 14*a* of the collar 14 can also serve as an abutment for the sleeve 24 as it moves axially with the rod 21. When the lip 23 is very long (as in the embodiment of FIGS. 5*a*, 5*b*) its free end can engage, at least in part, in the groove 13 when the shutter 2 is in the open position.

When the pressure in the tank R increases, the substance P passes via the empty annular space defined by the sleeve 5 and the stud 25 so as to reach the upstream compartment of the thimble 1.

This space is narrow, but is matched to the viscosity of the substance P so as to brake its flow from the tank R to the inside volume of the thimble 1.

Thereafter, the substance deforms the lip 23 and penetrates into the downstream compartment of the thimble 1.

It then exerts thrust on the plug 20 which moves axially out from the orifice 10. This movement compresses the spring 3 thus releasing a passage for the substance P towards the outside between the rod 21 and the collar 14.

In the embodiment shown in FIGS. 5*a* and 5*b*, the transverse wall 22 is elastically deformable and it is retained against the end of the coupling 11 of the thimble 1, thereby forming resilient return means for the shutter 2. The wall 22 and the lip 23 are united by a central collar 26 which is clamped in a neck 21*a* of the rod 21.

The wall 22 is perforated so as to leave passages for the substance P between the tank R and the upstream compartment of the thimble.

We claim:

1. A nozzle for dispensing a liquid or semi-liquid substance (P) and designed to be mounted on a tank (R) suitable for being put under pressure, said nozzle comprising:

a thimble (1) having a coupling end (11) for coupling to the tank (R), an ejection orifice (10) and an inside wall, said thimble (1) defining a space therein;

a moving shutter (2) housed inside said thimble (1), said shutter being constituted by a rod (21) having a plug (20) at an outer end thereof and a transverse wall (22) at an inner end thereof, said lug (20) cooperating with said ejection orifice (10) to form a delivery valve, said transverse wall (22) leaving a passage for the substance (P) and cooperating with a resilient return means (3) for biasing said shutter (2) towards a closed position in which said plug (20) is engaged in a sealed manner in said ejection orifice (10); and an admission valve constituted by a deformable peripheral lip (23) disposed in the passage for the substance (P) so as to subdivide said space inside said thimble (1) in a sealed manner into an upstream compartment and a downstream compartment.

2. A nozzle according to claim 1, wherein said lip (23) is secured to said rod (21) and, in said closed position of the nozzle, a free end of said lip (23) is in bearing contact against said inside wall of said thimble (1).

3. A nozzle according to claim 1, wherein said lip (23) is carried by a ring that is coaxial with said rod (21).

4. A nozzle according to claim 3, wherein said transverse wall (22) is integrally formed with said ring.

5. A nozzle according to claim 1, wherein an upstream end of said shutter (2) is secured to said lip (23).

6. A nozzle according to claim 1, wherein said transverse wall (22) is resiliently deformable and is retained by a peripheral edge thereof at said coupling end (11) of said thimble (1), thereby forming said resilient return means for said shutter (2).

7. A nozzle according to claim 1, wherein said rod (21) is axial and together with said transverse wall (22) defines a peripheral shoulder (22*a*).

8. A nozzle according to claim 7, wherein said resilient return means (3) comprise a helical spring surrounding said rod (21) of said shutter (2), said spring having a rear end bearing against said shoulder (22*a*) and a front end bearing against said inside wall of said thimble (1).

9. A nozzle according to claim 8, wherein said front end of said spring (3) bears against longitudinal ribs (12) extending along said inside wall of said thimble (1).

10. A nozzle according to claim 1 wherein said plug (20) is constituted by a body (20*a*) and a head (20*b*), said body (20*a*) having a side face which in said closed position is pressed in a sealed manner against an inside edge (10*a*) of said ejection orifice (10), said head (20*b*) projecting from said thimble (1).

11. A nozzle according to claim 10, wherein said ejection orifice (10) has a frustoconical profile which corresponds to a profile of said body (20*a*) of said plug (20).

12. A nozzle according to claim 10, wherein said inside edge (10*a*) of said ejection orifice (10) is provided with an annular ring against which said side face of said body (20*a*) bears in a sealed manner when in said closed position.

13. A nozzle according to claim 10 wherein said thimble (1) has a bullet-shaped profile, and said head (20*b*) of said plug (20) has a curvilinear profile of curvature defined so as to appear to continue said bullet-shaped profile.

14. A nozzle according to claim 1, wherein said coupling end (11) of said thimble (1) has ribs (11*a*) on said inside wall thereof which constitute an abutment for said transverse wall (22).

15. A nozzle according to claim 1, wherein said rod (21) is secured to said transverse wall (22) by being engaged in a clamping sleeve (24) carrying said transverse wall (22).

16. A nozzle according to claim 1, further comprising: a removable cap (4) designed to cover said thimble (1), said cap 4 having an end wall with an inside face which bears against said plug (20) so as to guarantee said sealed engagement of said plug (20) in said ejection orifice (10) in said closed position.

17. A nozzle according to claim 8, further comprising:

an annular groove (13) formed in said inside wall of said thimble (1), said annular groove (13) having an inside edge which defines a collar (14) for guiding said rod (21);

wherein said front end of said spring (3) bears against a bottom of said annular groove (13).

18. A nozzle according to claim 1, further comprising:

a sleeve (5) arranged to project into the tank (R);

wherein said transverse wall (22) includes a stud (25) which extends towards the tank (R) and is engaged in said sleeve (5).

* * * * *